US008276690B2

(12) United States Patent
Lee

(10) Patent No.: US 8,276,690 B2
(45) Date of Patent: Oct. 2, 2012

(54) EXPANDABLE DOWNHOLE TOOL

(76) Inventor: Paul Bernard Lee, Calgary (CA)

( * ) Notice: Subject to any disclaimer, the term of this patent is extended or adjusted under 35 U.S.C. 154(b) by 0 days.

(21) Appl. No.: 13/015,964

(22) Filed: Jan. 28, 2011

(65) Prior Publication Data

US 2011/0120777 A1 May 26, 2011

Related U.S. Application Data

(62) Division of application No. 12/064,227, filed as application No. PCT/IB2007/001494 on Jun. 6, 2007, now Pat. No. 7,891,441.

(30) Foreign Application Priority Data

Jun. 10, 2006 (GB) ..... 0611514.1
Dec. 19, 2006 (GB) ..... 0625254.8

(51) Int. Cl.
*E21B 10/32* (2006.01)

(52) U.S. Cl. ..... 175/267; 175/286

(58) Field of Classification Search ..... 175/286, 175/288, 267, 268
See application file for complete search history.

(56) References Cited

U.S. PATENT DOCUMENTS

| | | | | |
|---|---|---|---|---|
| 1,710,998 | A | 4/1929 | Rudkin | |
| 2,450,223 | A | 9/1948 | Barbour | |
| 2,485,826 | A | 10/1949 | Harinck | |
| 3,123,162 | A | 3/1964 | Rowley | |
| 3,379,266 | A | 4/1968 | Fletcher | |
| 4,068,711 | A | 1/1978 | Aulenbacher | |
| 4,842,082 | A | 6/1989 | Springer | |
| 4,846,290 | A | 7/1989 | Jones | |
| 5,318,138 | A | 6/1994 | Dewey et al. | |
| 6,059,051 | A | 5/2000 | Jewkes et al. | |
| 6,070,677 | A | 6/2000 | Johnston | |
| 6,213,226 | B1 | 4/2001 | Eppink et al. | |
| 6,732,817 | B2 | 5/2004 | Dewey et al. | |
| 6,920,944 | B2 | 7/2005 | Eppink et al. | |
| 6,976,547 | B2 | 12/2005 | Rial et al. | |
| 7,036,611 | B2 * | 5/2006 | Radford et al. | 175/57 |
| 7,048,078 | B2 | 5/2006 | Dewey et al. | |
| 7,506,703 | B2 | 3/2009 | Campbell et al. | |

FOREIGN PATENT DOCUMENTS

GB 2421744 A 7/2006

* cited by examiner

*Primary Examiner* — David Andrews
(74) *Attorney, Agent, or Firm* — Kirton McConkie; Evan R. Witt

(57) ABSTRACT

An expandable downhole tool such as an under-reamer or a stabiliser includes a mandrel mounted for linear slidable movement relative to a main body. The mandrel, together with one or more travel blocks, cause movement of a working component in an axial direction. One or more outwardly extending guide paths slidably interact with the working component to cause the working component to move between a withdrawn inoperative position and an outwardly deployed operative position. Upon increase of hydraulic pressure from below the tool, the mandrel is urged against a spring biasing the deactivated position to move axially and cause the working component to take its operative position. Upon decrease of hydraulic pressure, the spring moves the mandrel axially to cause the working component to take its withdrawn inoperative position.

10 Claims, 11 Drawing Sheets

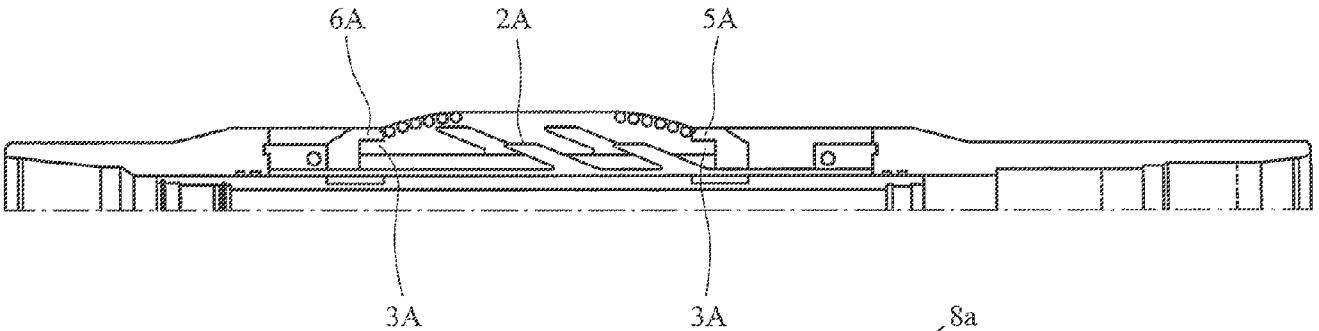
FIG. 9A
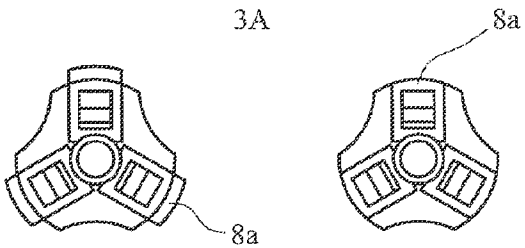
FIG. 9B
FIG. 10B
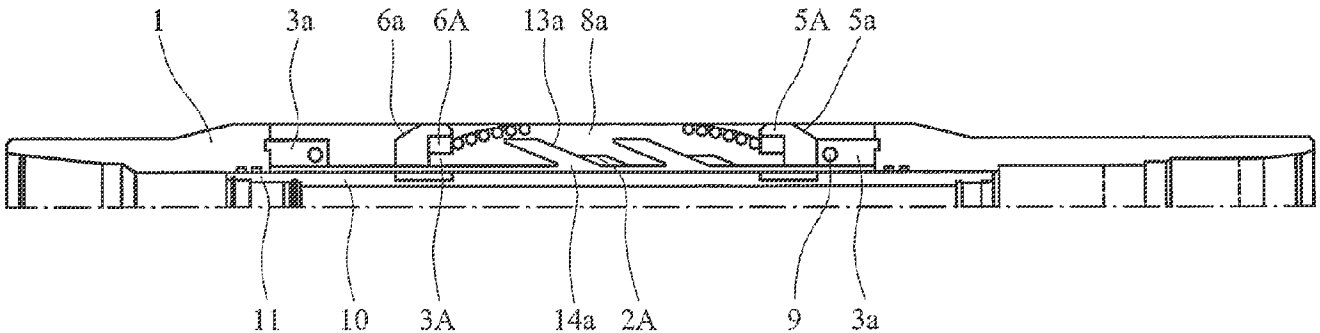
FIG. 10A

EXPANDABLE DOWNHOLE TOOL

CROSS-REFERENCE TO RELATED APPLICATION

This application is a divisional of U.S. application Ser. No. 12/064,227, filed Feb. 19, 2008 which was the National Stage of International Application No. PCT/IB07/01494, filed Jun. 6, 2007.

BACKGROUND OF THE INVENTION

This invention relates to an expandable downhole tool for incorporation in a drillstring, such as an under-reamer or a stabiliser.

Under-reamers are normally used to enlarge a borehole below a restriction, to result in a borehole that is larger than the restriction. Stabilisers are used to control the direction of a drill bit during the drilling process.

The present invention relates to an expandable tool that may function as an under-reamer, or alternatively may function as a stabiliser in an undereamed portion of a borehole.

It will be well known to those of ordinary skill in the art, in the drilling of oil and gas wells, to employ under-reamers and stabilisers, and detailed description of their normal function is not considered necessary.

U.S. Pat. No. 6,732,817 describes a downhole tool that functions as an underreamer, or alternatively, as a stabilizer in an underreamed borehole. The tool comprises one or more moveable arms disposed within recesses in the tool. The tool alternates between collapsed and expanded positions in response to differential fluid pressure between the flowbore and the wellbore annulus. The recesses comprise angled channels that slidably engage extensions formed on the arms such that when the tool expands, the arms are translated axially upwardly, while simultaneously being extended radially outwardly from the body.

The apparatus described in U.S. Pat. No. 6,732,817 suffers from the drawback that the recesses must be formed with integral angled channels, which increases the complexity and cost of the tool. Also, if the angled channels in the recesses become damaged or subject to wear and tear, they are relatively costly and difficult to replace. The apparatus of U.S. Pat. No. 6,732,817 also suffers from the drawback that the cutter blocks do not lock in the outward position such that the blocks can float up and down on inclined plains causing vibration and wear and tear. This can also result in the tool not cutting a well bore to the desired size.

BRIEF SUMMARY OF THE INVENTION

The present invention seeks to provide an expandable downhole tool, such as an under-reamer or stabiliser, and which is easily assembled, and capable of reliably expanding outwardly to an operative position, and then moving inwardly to take up a withdrawn inoperative position.

According to an aspect of the present invention, there is provided an expandable downhole tool for incorporation in a drillstring, the tool capable of being adjusted between activated and deactivated modes, said tool comprising:

a tool body;

a working component mounted indirectly on the tool body for movement relative to the tool body between a withdrawn inoperative position and an outwardly deployed operative position corresponding respectively to the deactivated and activated modes of the tool;

a mandrel slidably mounted in the main body for axial movement between first and second positions, said mandrel taking up the first axial position in the deactivated mode of the tool and being displaceable to the second axial position in order to activate the tool to its activated mode;

a spline bar mountable in a recess in the tool body and defining a first linear guide path extending parallel to the axis of movement of the mandrel, and a second outwardly extending guide path; and at least one first travel block coupled with the mandrel for movement therewith and slidably mountable on said spline bar for movement along said first linear guide path;

in which the working component is mountable on the spline bar for movement along said second outwardly extending guide path, at least one said first travel block being engagable with the working component as the mandrel moves from its first position to its second position in order to move the working component along the second outwardly extending path from its withdrawn position to its outwardly deployed position.

This provides the advantage of a simple and easy to assemble tool which does not rely upon any internal design of the tool body to guide the inward and outward movement of the working components. A separate mechanical component is provided, namely the spline bar, which, upon assembly with the tool body, remains fixed and serves as the main means (providing the first and second guide paths referred to above) by which the sub-assembly of cutter block and travel blocks is movably mounted on the main body.

In a preferred embodiment, the tool includes at least one second travel block coupled with the mandrel for movement therewith and slidably mounted on said spline bar for movement along said first linear guide path, at least one said second travel block being engagable with the working component as the mandrel moves from its second position to its first position in order to move the working component along the second guide path from its outwardly deployed position to its withdrawn position.

In a preferred embodiment, the spline bar is fixedly mounted in the recess by at least one lock block.

This provides the advantage of a relatively simple means of removably mounting the spline bar in the recess to facilitate removal and replacement of the spline bar for repair.

In a preferred embodiment, the first linear guide path is defined by the axis of the spline bar, and the second outwardly extending guide path is defined by a sloping guide ramp provided on the spline bar.

The mandrel may be arranged to be biased towards the first axial position, and to be movable under hydraulic pressure action against the biasing to take up its second axial position.

The mandrel may be arranged to be displaced from the first to the second position upon launch of an activator down the drillstring.

In a preferred embodiment, the spline bar and the working component have cooperating guide elements which define said second guide path.

In a preferred embodiment, the guide elements comprise at least one sloping ramp on the spline bar and a corresponding guide slot in the working component.

The tool may further comprise at least one shoulder formed in at least one said first travel block and at least one step formed on said working component, wherein engagement between at least one step and at least one said shoulder prevents the working component from becoming detached from the tool.

This provides the advantage of a relatively simple means of ensuring that the working member does not fall out of the tool.

The tool may further comprise at least one pocket formed in said working component, wherein engagement between at least one flat formed on a top of said sloping ramp with at least one said pocket locks said working component in the outwardly deployed operative position.

This provides the advantage that the working component can be locked in the outwardly deployed position which reduces vibration and wear and tear and ensures that the tool cuts a well bore to the desired size.

At least one said first travel block may have a pivotal connection with an adjacent end of the working component.

The sloping ramp may have a projecting nose which is engagable with an internal shoulder in a slideway in order to retain the working component in its withdrawn position.

An opposite end of the cutter block may be engageable with and held captive by a ramp provided on a lock block which limits linear movement of the mandrel to determine said second axial position corresponding to the activated mode of the tool.

The working component may be a cutter block of an under-reamer or a stabiliser.

According to another aspect of the present invention, there is provided a downhole tool for incorporation in a drillstring, the tool capable of being adjusted between activated and deactivated modes, said tool comprising:

a tool body;

a working component mounted on the tool body for movement relative to the tool body between a withdrawn inoperative position and an outwardly deployed operative position corresponding respectively to the deactivated and activated modes of the tool, said working component comprising pivotally interconnected first and second arm portions;

a mandrel slidably mounted in the tool body for axial movement between first and second positions, said mandrel taking up the first axial position in the deactivated mode of the tool and being displaceable to the second axial position in order to activate the tool to its activated mode;

wherein said mandrel is pivotally interconnected with said first or second arm portion such that movement of the mandrel from the first position to the second position moves the working component between the withdrawn inoperative position and the outwardly deployed operative position.

This provides the advantage of a simple and easy to assemble tool which does not rely upon any internal design of the tool body to guide the inward and outward movement of the working components.

In a preferred embodiment, the tool further comprises at least one third travel block coupled with the mandrel for movement therewith, wherein at least one said third travel block is pivotally interconnected with said first or second arm portion.

The working component may be a cutter block of an under-reamer or a stabiliser.

BRIEF DESCRIPTION OF THE DRAWINGS

Preferred embodiments of expandable downhole tool according to the invention will now be described in detail, by way of example only, with reference to the accompanying drawings in which:

FIG. 9A shows in more detail the embodiment of FIGS. 6 to 8, in the outwardly expanded operative position;

FIG. 9B is a cross sectional view of FIG. 9A;

FIG. 10A is a view, similar to FIG. 9A, showing the embodiment in the withdrawn inoperative position;

FIG. 10B is a cross sectional view of FIG. 10A;

DETAILED DESCRIPTION OF THE INVENTION

Figure 1:
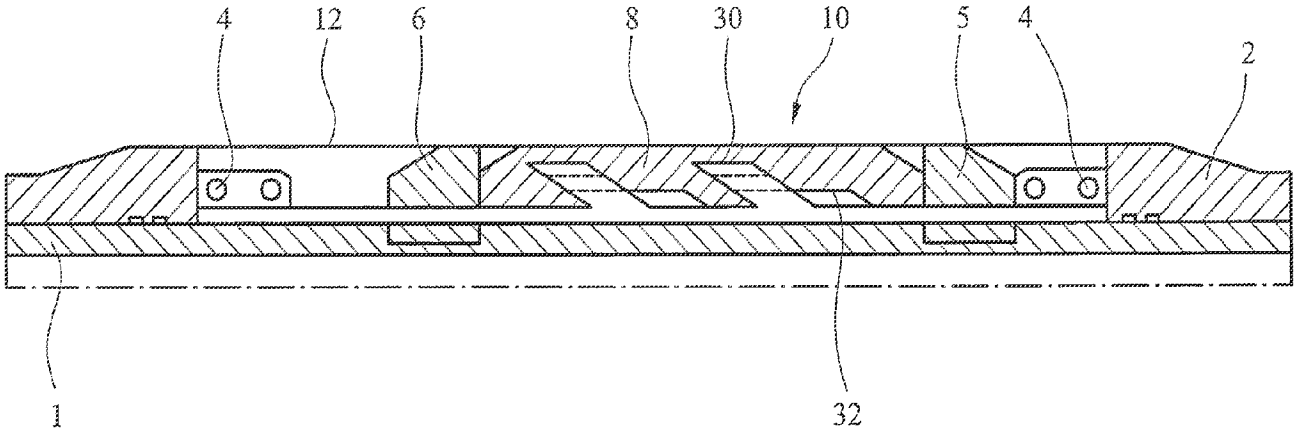
FIG. 1 is a detail sectional view of a first embodiment of expandable downhole tool according to the invention, taking the form of an under-reamer, and showing the reamer blades in the withdrawn inoperative position with respect to the body of the tool in which it is mounted.
Figure 2:
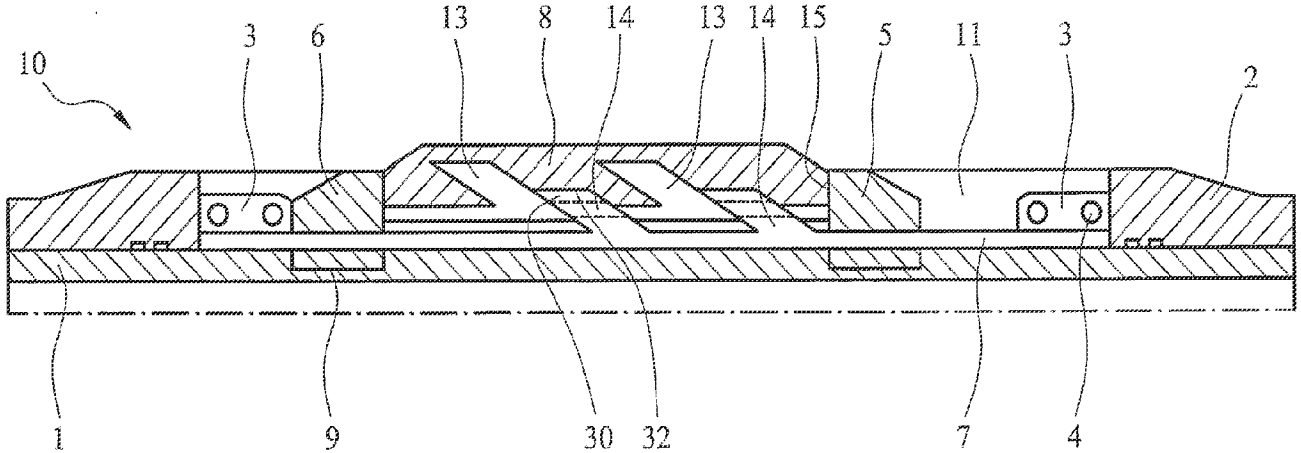
FIG. 2 is a view, similar to FIG. 1, but showing the reamer blades in an outwardly expanded operative position.
Figure 3:
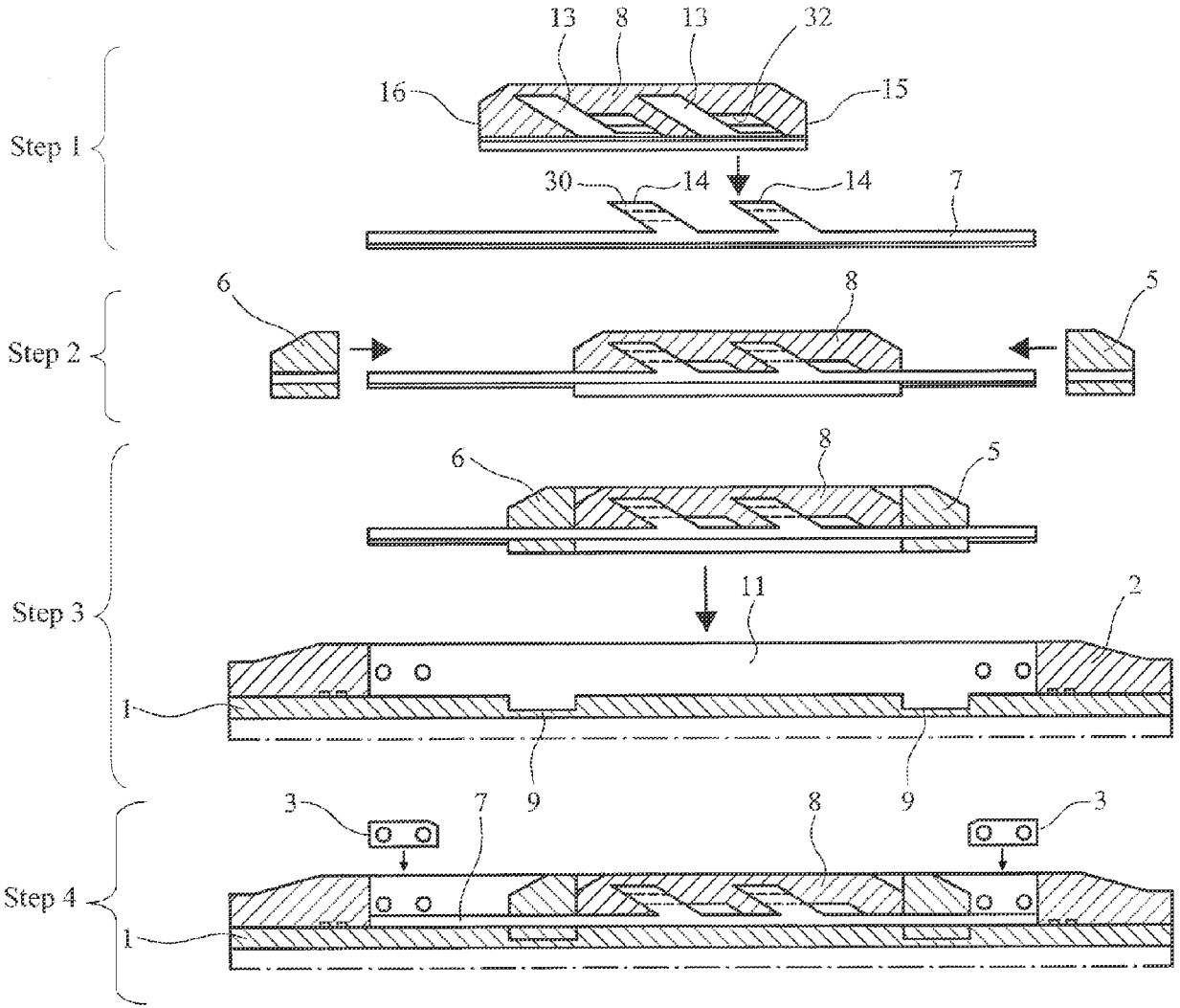
FIG. 3 is an exploded view showing individual components and steps involved in completing the assembly of the under-reamer in the tool.

Referring first to FIGS. 1 to 3 of the drawings, an expandable downhole tool according to the invention, as per this first embodiment, takes the form of an under-reamer designated generally by reference 10 and having reamer blades provided on a reamer cutter block 8 which is shown in FIG. 1 in its withdrawn inoperative position relative to the main body 2 of the tool (on which it is indirectly mounted).

The tool also has a usual mandrel 1 mounted for linear slidable movement relative to the main body 2 between the inoperative position (a first axial position) of the tool shown in FIG. 1, and the operative position (a second axial position) of the tool shown in FIG. 2. The mandrel 1 is normally biased by spring force (not shown) from the top, so as to take up the inoperative position shown in FIG. 1. However, upon application of hydraulic pressure to the bottom of the mandrel 1, this can overcome the spring force and thereby move the mandrel 1 to the operative position shown in FIG. 2. Subsequently, upon reduction of the hydraulic pressure, the mandrel reverts under spring action to the inoperative position shown in FIG. 1.

It should be understood, however, that the use of hydraulic pressure and spring force are just one preferred example of the means employed to activate and deactivate the under-reamer tool 10. Other means of applying activation forces and deactivation forces to the mandrel may be employed, as will be readily apparent to those of ordinary skill in the art.

FIGS. 1 and 2 show the assembled components of the tool, whereas FIG. 3 is an exploded view showing the individual components, and the subsequent steps in completing the assembly of the tool. The further component parts of the tool, and the steps in the assembly will now be described in detail with reference to FIG. 3.

A fixed guide takes the form of a spline bar 7 which is an immovable component of the tool, and is of a length sufficient to fit within an axial recess 11 in the main body 2, and when installed as shown in the lower view of FIG. 3, it is restrained from movement longitudinally and laterally. To retain the spline bar 7 in position, lock blocks 3 are provided which can be bolted to a surrounding housing 12 of the main body 2 in which axial recess 11 is formed, by means of lock pins 4.

The longitudinally slidable mandrel 1 has two axially spaced cut-out recesses 9, into which can be received the lower ends of travel blocks 5 and 6 as can be seen in FIG. 1. The assembly of the travel blocks 5 and 6, together with cutter block 8, on the spline bar 7 will be apparent from the exploded view of FIG. 3.

In particular, cutter block 8 has obliquely outwardly extending guide ways 13 which are slidably mounted on similarly shaped slide ramps 14 projecting outwardly from the spline bar 7. After assembly of the cutter block 8 on the spline bar 7, the travel blocks 5 and 6 are then slidably mounted on opposite ends of the spline bar 7, and move towards each other to engagement with respective end faces 15 and 16 of the cutter block 8 to form a sub-assembly, capable of being dropped into position in the axial recess 11 as shown in the lower view of FIG. 3.

The travel blocks 5 and 6 locate the cutter block 8 axially with respect to the slidable mandrel 1, by engagement of the travel blocks 5 and 6 in the mandrel recesses 9. The sub-assembly of the cutter block 8, spline bar 7 and travel blocks 5 and 6 are then capable of movement as a unit with the mandrel 1, upon activation and deactivation of the tool. As mentioned above, the spline bar 7 is retained against movement by its mounting in the axial recess 11 of housing 12, and by means of the lock blocks 3. However, the cutter block 8 of the sub-assembly is capable of linear displacement between the withdrawn position shown in FIG. 1 which is the deactivated mode of the tool, and the upwardly expanded operative position of FIG. 2, which is the activated mode of the tool.

Upon increase of hydraulic pressure from below the tool, the mandrel 1 is urged to the left against its spring biasing from the deactivated position shown in FIG. 1, in order to take up the axially displaced position shown in FIG. 2, which corresponds to the activated mode of the tool. The travel blocks 5 and 6 follow this linear movement of the mandrel 1, by virtue of their location in mandrel recesses 9, and also follow a first linear guide path defined by the axis of spline bar 8. Also, because travel block 5 engages adjacent end face 15 of the cutter block 8, the cutter block 8 is urged outwardly to the extended position shown in FIG. 2, by obliquely outward sliding movement of guide ways 13 on slide ramps 14 (which define a second outwardly extending guide path).

To deactivate the tool, the mandrel 1 moves linearly to the right from the position shown in FIG. 2 to again resume the position shown in FIG. 1, and in this case it is the travel block 6 which engages end face 16 of the cutter block 8, to urge the cutter block 8 to move obliquely inwardly to the withdrawn position of FIG. 1.

Provision is made for the reamer block 8 to be locked in its outwardly deployed position, and conveniently this is achieved by milling a flat along the female track in the cutter block 8, and utilising a dove-tail on the spline bar in the expanded position.

The embodiment disclosed herein therefore provides a simple and easy to assemble under-reamer tool, and which does not rely upon any internal design of the main body 2, to guide the inward and outward movement of the cutter block 8. A separate mechanical component is provided, namely spline bar 7, which, upon assembly with the main body 2, remains fixed, and serves as the main means (providing the first and second guide paths referred to above) by which the sub-assembly of cutter block 8 and travel blocks 5 and 6 is movably mounted on the main body 2. The block concept embodied in this design, namely cutter block 8 to form the reamer blades, and travel blocks 5 and 6 which hold the sub-assembly together, gives advantages over existing designs of expandable downhole tools, and particularly by providing more room and structure in which to apply the cutter inserts. Also, there is the advantage that less seals are required to hold differential pressure, and therefore less potential failure points.

The under-reamer 10 described above with reference to FIGS. 1 to 3 is shown in more detail when assembled in a drillstring designated generally by reference 17 in FIGS. 4 and 5. These Figures also show in more detail the means by which the tool is capable of being locked in the outwardly deployed position, in which slide ways 13 and slide ramps 14 cooperate via male dovetails 30 and female dovetails 32.

Further advantage of the disclosed embodiment is that the spline bar/track system has smaller components than existing designs of downhole expandable tool, making it easy to maintain and manufacture. Also, it is a rugged and simple structure of proven internal components.

Figure 4A:
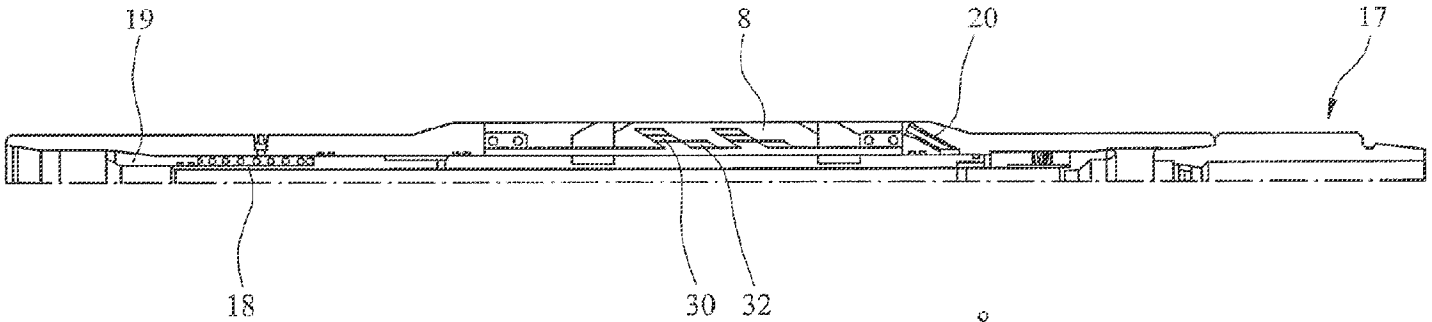
FIG. 4A is a longitudinal sectional view showing the under-reamer tool of FIGS. 1 to 3 assembled in a part of a drillstring, and showing the under-reamer tool in the withdrawn inoperative position.
Figure 5A:
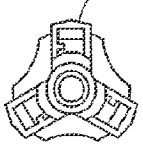
FIG. 5A is a view, similar to FIG. 4A, and showing the under-reamer tool in the outwardly extended operative position.
Figure 4B:
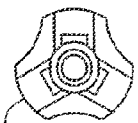
FIG. 4B is a cross sectional view of FIG. 4A.
Figure 5B:
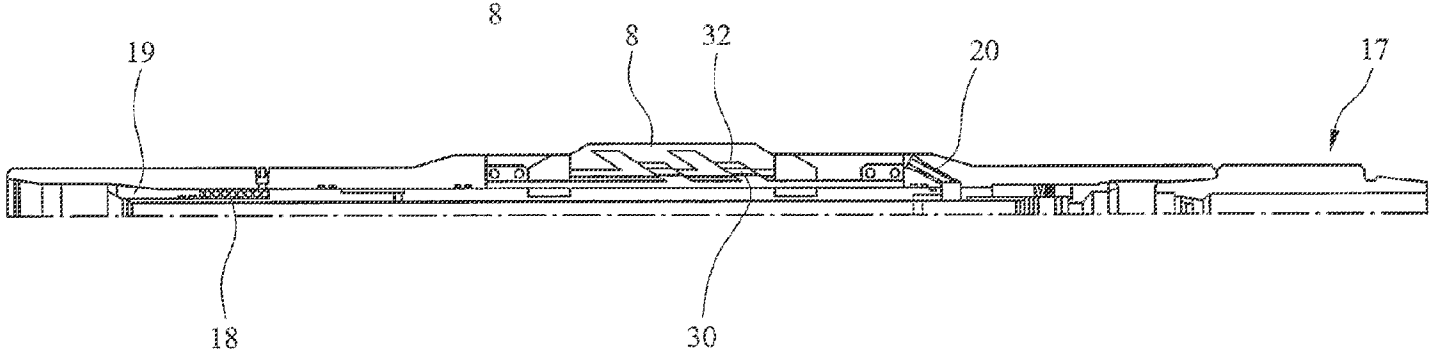
FIG. 5B is a cross sectional view of FIG. 5A.
Figure 8:
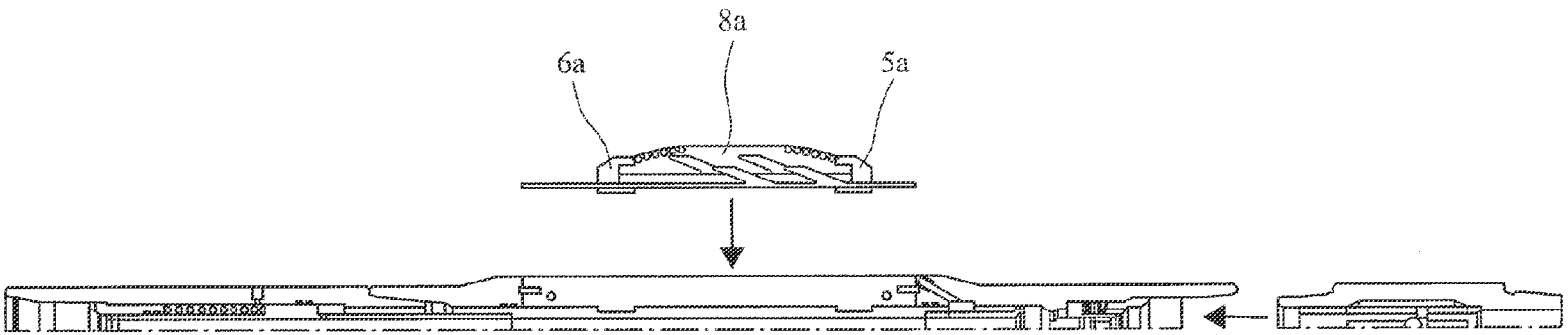
FIG. 8 is an exploded view showing the individual components, and the steps involved in assembly of the embodiment of FIGS. 6 and 7.
Figure 7:
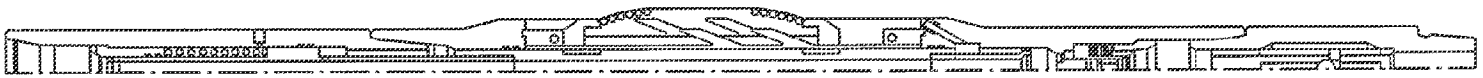
FIG. 7 is a view, similar to FIG. 6, showing the reamer blades in the outwardly extended operative position.
Figure 6:
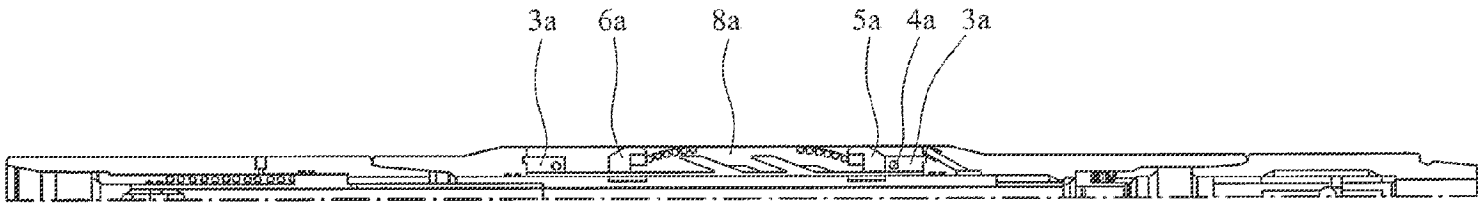
FIG. 6 is a longitudinal sectional view illustrating in more detail the components of a further embodiment of under-reamer tool according to the invention, mounted in a drillstring, and showing the reamer blades in the withdrawn inoperative position.

FIGS. 4A, 4B, 5A and 5B also show biasing spring 18 mounted in annular chamber 19, and which normally biases the mandrel 1 in a direction towards the right in FIG. 4A, so that the cutter block 8 takes up the withdrawn position shown in FIGS. 4A and 4B, in the absence of sufficient hydraulic pressure. However, when sufficient hydraulic pressure is generated below the mandrel 1, this pushes the mandrel to the left against the action of the spring 18, so that the cutter block 8 moves to the outwardly deployed position shown in FIGS. 5A and 5B. Annular port or ports communicate with pressure in the annulus, and also communicates such pressure with the annular chamber 19, to force the mandrel 1 against the return spring 18. When the pumps are kicked out, and pressure in the annulus and the internal diameter of the drillstring equalise, the return spring 18 pushes the mandrel 1, thereby pulling the cutter block 8 down and in.

To activate the tool, a ball or ball cluster can be launched down the drillstring to trigger activation of the tool mechanically. Alternatively, a ball or ball cluster can be launched down the drillstring to engage a seat and cause the tool to activate on increased pressure differential.

Conveniently, although not shown, a latch system may be provided which will resist activation of the tool until a pre-set pressure differential is applied. The tool will also include a nozzle arrangement, as shown by reference 20, so that when the tool is activated, it will open up the nozzle or nozzles, thereby allowing identification at the surface of activation of the tool, as well as cooling and cleaning the cutter blocks 8. Although not shown, a plurality of cutter blocks 8 will be provided, circumferentially spaced apart from each other, and each mounted on spline bar and having travel blocks, as described above.

Referring now to FIGS. 6 to 10, this shows a further embodiment of expandable downhole tool according to the invention, and generally corresponding parts are given the same reference numerals plus a. This design has modified travelling blocks 5*a*, 6*a* that will lock the movement of the cutter block at a preset outward diameter. The cutter block also has a flat that allows the cutter block to lock on the spline guide at the preset desired diameter. The travelling blocks will always hold the cutter block from falling out of the assembly as they engage the mandrel the same as the previous design, (see FIG. 10 showing the main body unit). The modifications are cutter block arm 3A and travelling block retainer 6A. 2A is the lock step on the cutter block. The benefit of this design is that it allows positive retraction as when the cutter block is pulled down it engages the spline guide for positive retraction.

The embodiment of FIGS. 6 to 10B operates in generally similar manner to the embodiment described above with reference to FIGS. 1 to 5B. However, as can be seen from in particular FIG. 10A, travelling blocks 5*a* and 6*a* have wings or shoulders 5A and 6A, and which serve to limit positively outward movement of the cutter block 8*a* and prevent cutter block 8*a* falling out of the tool. The cutter block 8*a* has laterally projecting steps or arms 3A, and as can be seen from FIG. 10A, there is radial clearance between steps 3A and shoulders 5A and 6A when the cutter block 8*a* is in the withdrawn position. This gap illustrates the extent of radial movement permitted as the cutter block 8*a* moves to its outwardly deployed position.

The flat or pocket 2A locks the cutter block 8*a* when it is deployed to its outer position. The cutter block 8*a* therefore rides up onto the arms of the spline guide. This wedges the cutter block in position, which is locked between the spline guide arm and the indentation on the travelling block. Consequently, in the position shown in FIGS. 9A and 9B, the cutter block 8*a* is locked in position by engagement of steps 3A with shoulders 5A, 6A, and engagement between the flats on the top of slide ramps 14*a* with pockets 2A. This also prevents cutter block 8*a* becoming detached from the tool.

A particular advantage of the described embodiments of the invention is that the cutter block assemblies can easily be changed from externally of the tool, without taking the tool apart internally.

Figure 11A:
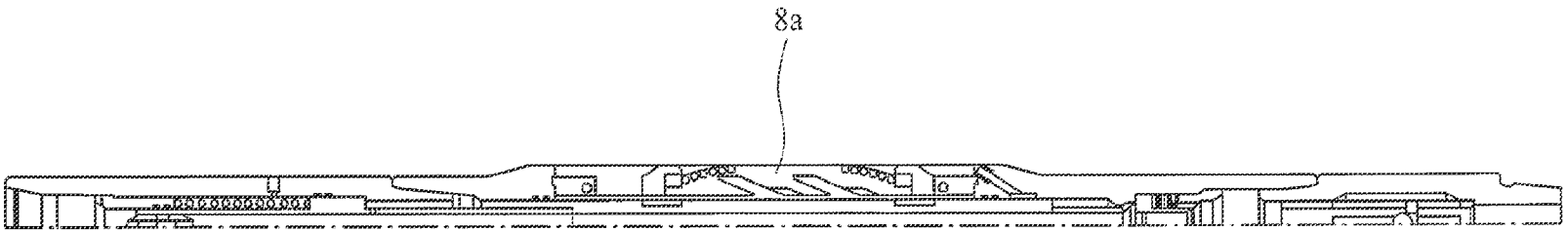
FIGS. 11*a* and 11*b* are longitudinal sectional views of an under-reamer tool according to the invention in combination with an activating dart launched down the drillstring to activate and deactivate the tool.
Figure 11B:
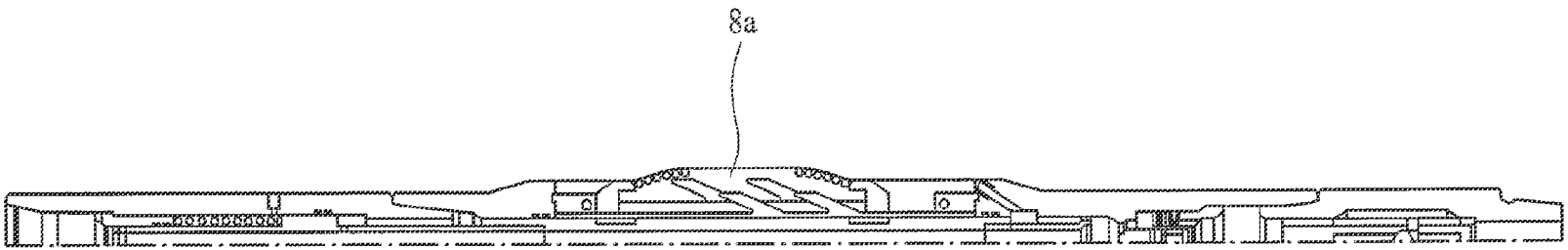

FIGS. 11*a* and 11*b* show an expandable downhole tool according to the invention which is capable of being triggered into activation by launching of a deformable activator down the drillstring. Subsequent deformation of the activator, to pass downwardly through a receiving seat, then allows the tool to reset itself automatically to the deactivated mode.

Figure 12A:
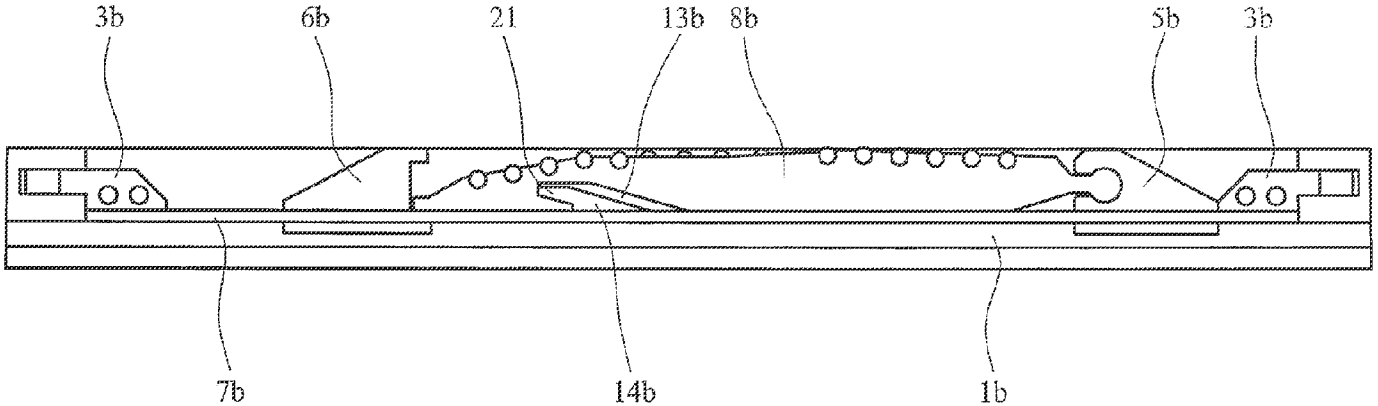
FIGS. 12*a* and *b* are a part illustration of a third embodiment of expandable downhole tool according to the invention.
Figure 12B:
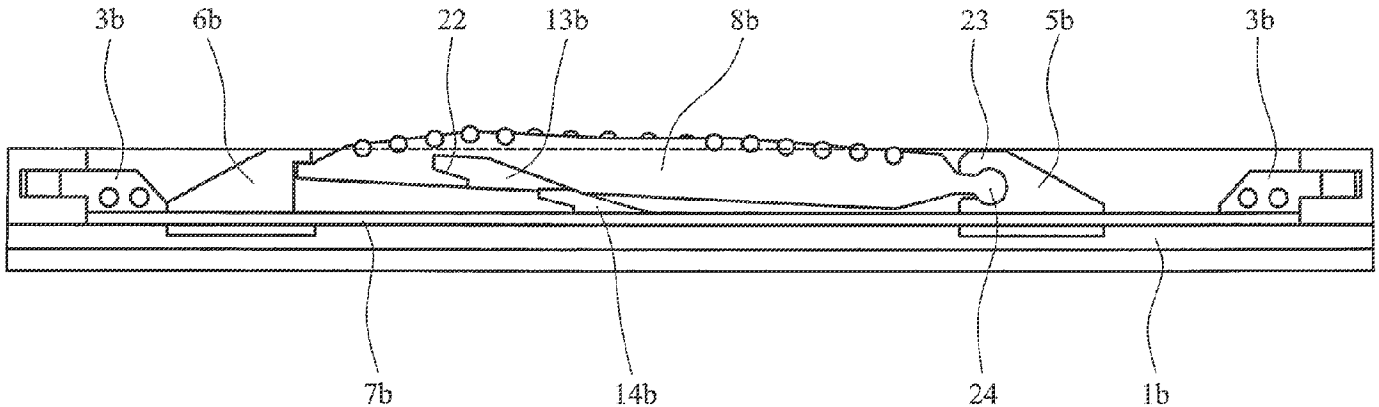

A third embodiment is shown in the part sectional illustration of FIGS. 12*a* and 12*b*, in which view (a) is the withdrawn, de-activated mode and view (b) is the expanded activated mode. Corresponding parts are given the same reference numerals, with addition of letter b. The spline bar 7*b* is retained against axial displacement in the main body 2*b*, and is held in position by lock blocks 3*b*. Travel blocks 5*b* and 6*b* are mounted on mandrel 1*b* for movement therewith, in order to expand and withdraw the cutter block 8*b*.

However, in this embodiment there is provision of a single ramp 14*b* which cooperates with single slideway 13*b* in cutter block 8*b*. Also, it should be noted that ramp 14*b* has a projecting nose 21 which constitutes a "locking travel guide" when it engages with an internal shoulder 22 of slideway 13*b* in the withdrawn (de-activated) position shown in view 12*a*.

Also, the travel block 5*b* is differently constructed to blocks 5 and 5*a* of the preceding embodiments, in that while it still functions as a travel block in order to move the cutter block 8*b* axially when the mandrel 1*b* is moved axially, it also has a pivotal connection 23 with the adjacent end 24 of the cutter block 8*b*. Conveniently, the connection between travel block 5*b* and cutter block 8*b* is a ball and socket type interconnection, as shown, though other constructions are possible.

The cutter block 8*b* therefore moves up the ramp 14*b* on the slide bar 7*b*, as the mandrel 1*b* and travel block 5*b* move to the left from the position of view 12*a* to that of view 12*b*. Such movement is allowed by pivoting of the cutter block 8*b* outwardly of the axis of the tool via the pivot connection 23, 24. Return movement results in inward pivoting of the cutter block 8*b* to the withdrawn position, and in which it is retained by engagement of nose 21 of ramp 14*b* on internal shoulder 22 of slideway 13*b*.

Figure 13A:
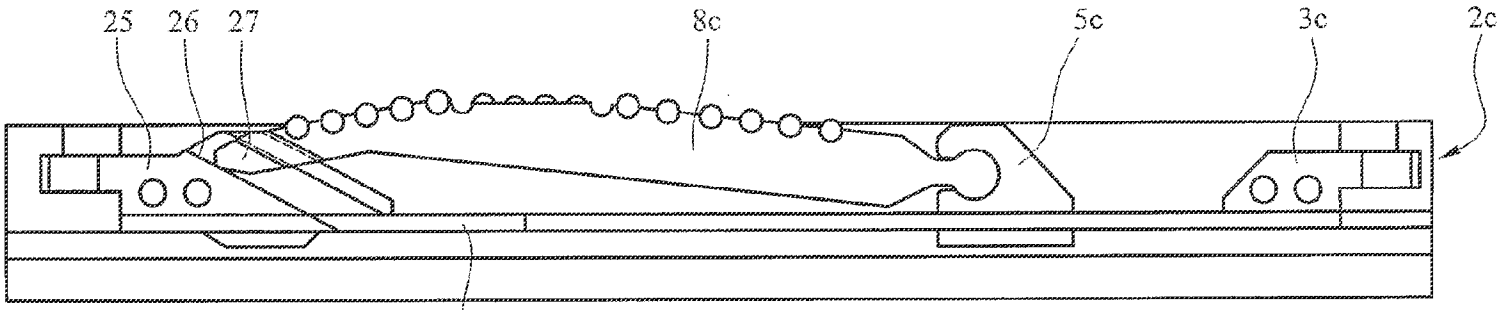
FIGS. 13*a*, 13*b* and 13*c* show successive stages of adjustment of a cutter body in a fourth embodiment of the invention.
Figure 13B:
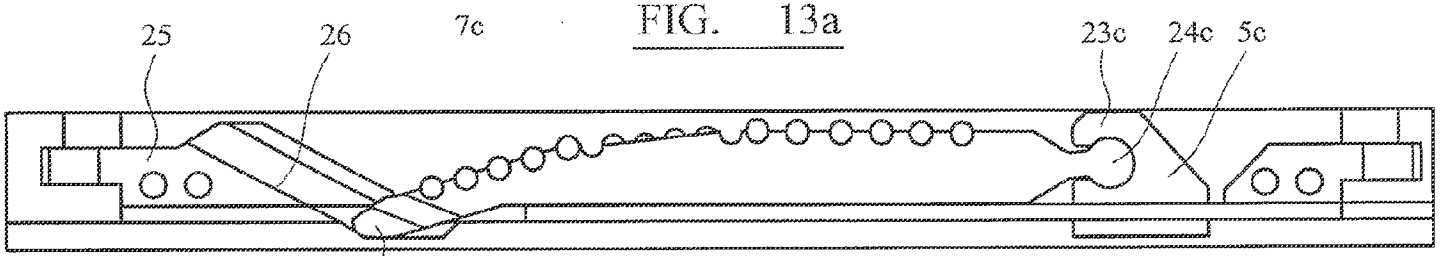

Referring now to FIGS. 13*a, b*, and *c* and 14*a, b*, and *c*, these show another embodiment, and corresponding parts to those already described are given the same reference numerals, but with the addition of the letter c.

FIGS. 13*a, b, c* and 14*a, b, c* show successive positions taken up by the cutter block 8*c* during movement between the outwardly deployed operative position and the inwardly withdrawn inoperative position relative to the main body 2*c*. Also, in this embodiment, travel block 5*c* moves linearly and therefore causes linear movement only of the adjacent (right hand) end of cutter block 8*c*, in similar manner to the movement of travel block 5*b* in the embodiment of FIGS. 12*a* and *b*.

However, there is no second travel block to correspond with travel block 6*b* of FIGS. 12*a* and *b*. Instead, a modified second lock block 25 is provided, and which defines an outwardly inclined guide ramp 26 which engages and holds captive the adjacent (left hand) end 27 of cutter block 8*c*.

Figure 13C:
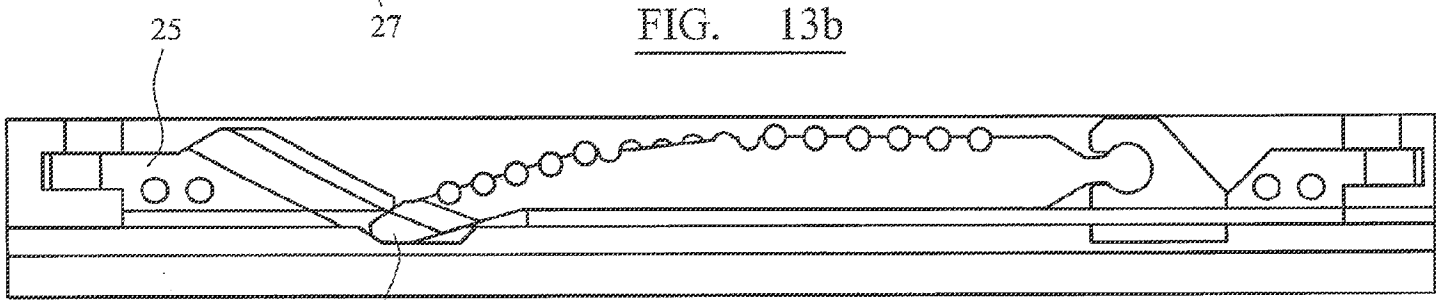
Figure 14A:
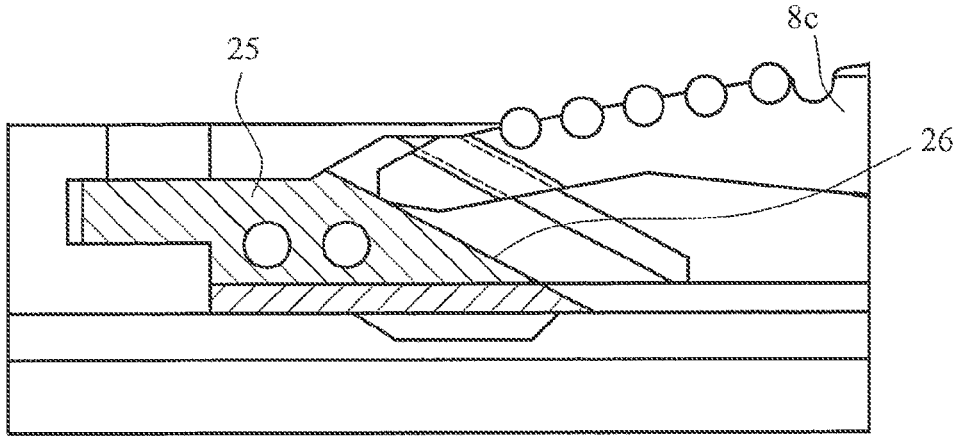
FIGS. 14*a*, 14*b* and 14*c* show corresponding enlarged detailed views.
Figure 14B:
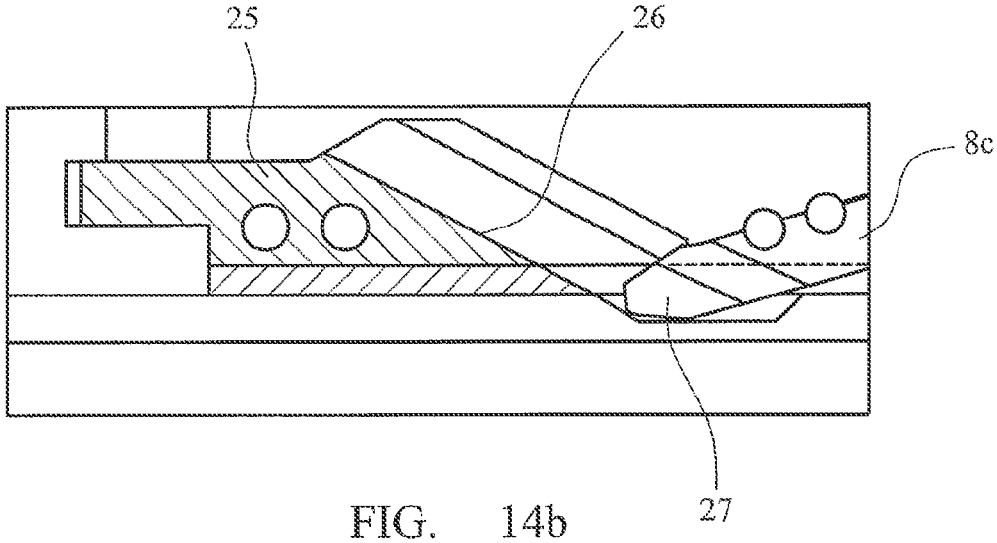
Figure 14C:
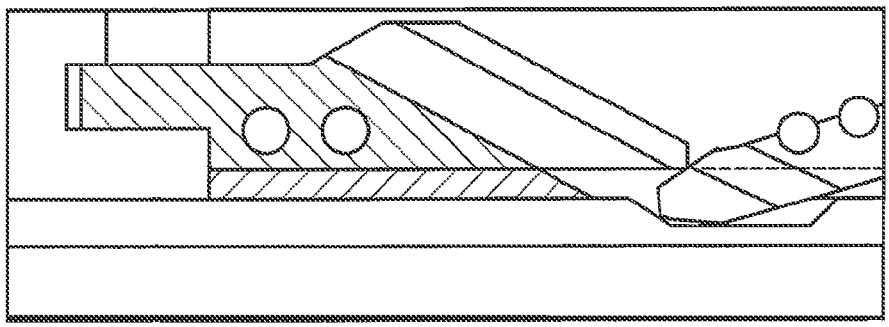

FIGS. 13*c* and 14*c* show the withdrawn positions of the end 27 of cutter block 8*c*, and FIGS. 13*a* and 14*a* show the outwardly deployed position.

FIGS. 13*a, b*, and *c*, therefore show a pivotable arm type connection 23*a* between the adjacent end 24*c* of cutter block 8*c* and the single travelling block 5*c*, whereas the opposite end 27 of the cutter block 8*c* engages with and is held captive by the differently constructed locking block 25. A dovetail configuration engages the end 27 of the cutter block 8*c* and holds it captive, so that the cutter block 8*c* carries out a combined linear movement and also radial movement by virtue of engagement between the ramp 26 and end 27, to move the cutter block between operative and inoperative positions. FIGS. 14*a*, b, and c show corresponding enlarged detail views.

Figure 15A:
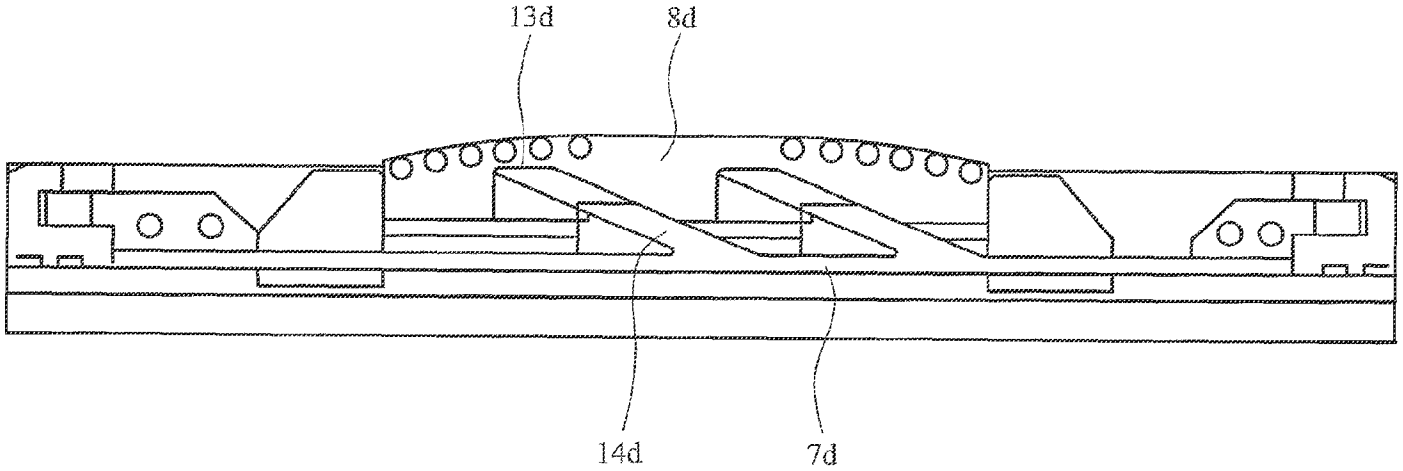
FIGS. 15*a* and 15*b* show longitudinal sectional views of a further embodiment of the invention.
Figure 15B:
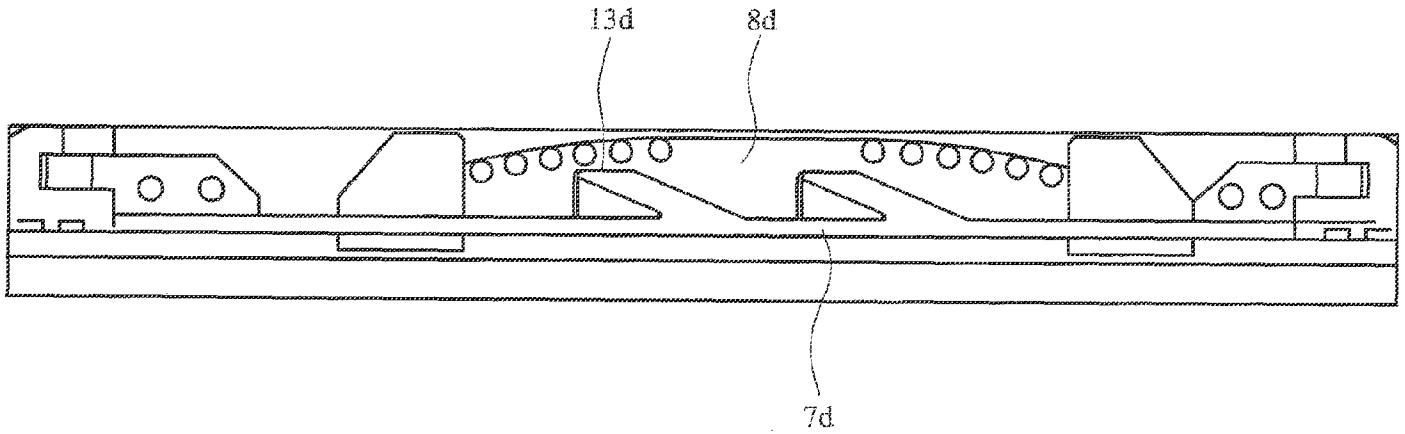

FIGS. 15*a* and 15*b* show an embodiment similar to that of FIGS. 6 to 10. FIG. 15*a* shows the tool in the expanded position and FIG. 15*b* shows the tool in the withdrawn position. Cutter block 8*d* comprises guide ways 13*d* and spline bar 7*d* comprises slide ramps 14*d*. It can be seen from the drawings that the embodiment shown in FIGS. 15*a* and 15*b* does not comprise wings and shoulders that limit outward movement of the cutter block 8*a* unlike the embodiment of FIGS. 6 to 10. However, since the cutter block 8*d* can only move a limited extent along spline bar 7*d* then there is not enough room for the cutter block 8*d* to move axially far enough for the guide ways 13*d* to become disengaged from the slide ramps 14*d*. This means that the cutter block 8*d* cannot become detached from the body of the tool.

Figure 16A:
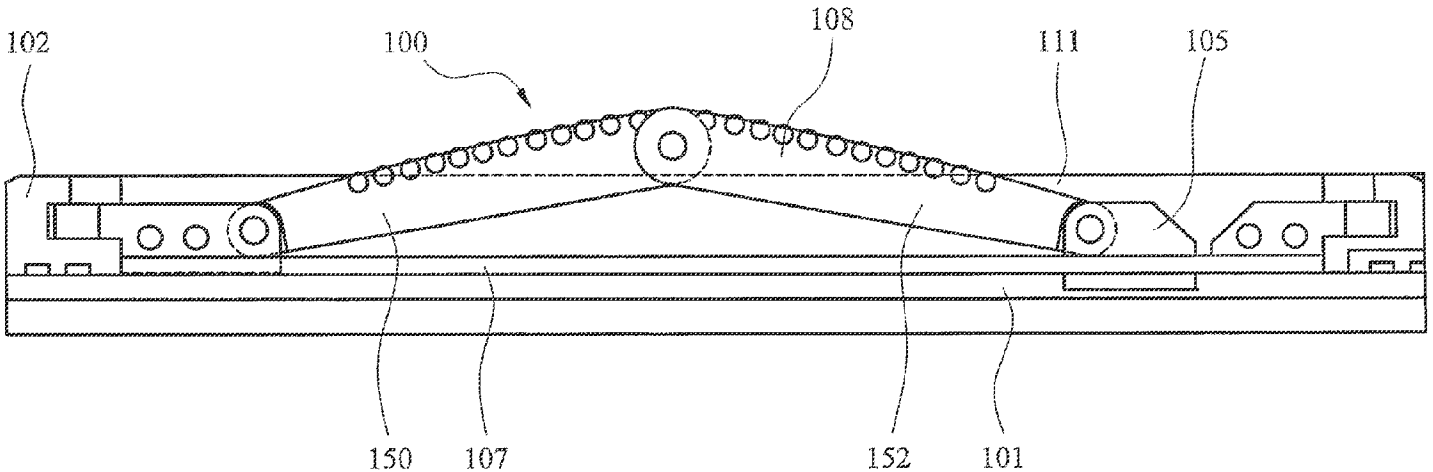
FIGS. 16*a* and 16*b* show longitudinal sectional views of a further embodiment of the invention.
Figure 16B:
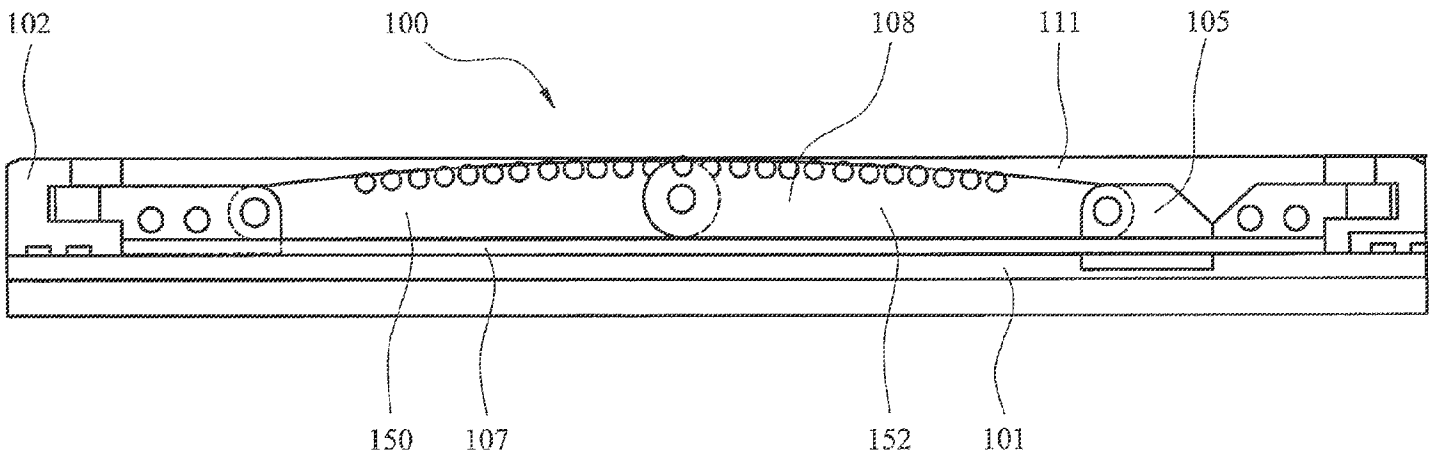

FIGS. 16*a* and 16*b* show a further embodiment of an expandable downhole tool 100 which comprises a tool body 102 and an expandable working component 108 disposed in recess 111. The expandable working component 108 comprises two pivotally interconnected arm portions 150 and 152. Arm portion 152 is pivotally interconnected to a third travel block 105 such that when the travel block 105 moves along the spline bar 107, the working component 108 can be deployed and retracted. It should be understood that the travel block could be formed integrally with the mandrel 101 such that mandrel could be pivotally interconnected directly with the first or second arm portion. The pivoting joints can be formed from pins received in respective bores.

It will be appreciated by person skilled in the art that the above embodiments have been described by way of example only and not in any limitative sense, and that various alterations and modifications are possible without departure from the scope of the invention as defined by the appended claims.

The invention claimed is:

1. An expandable downhole tool for incorporation in a drillstring, the tool capable of being adjusted between activated and deactivated modes, said tool comprising:

a tool body;

a working component mounted indirectly on the tool body for movement relative to the tool body between a withdrawn inoperative position and an outwardly deployed operative position corresponding respectively to the deactivated and activated modes of the tool;

a mandrel slidably mounted in the main body for axial movement between first and second positions, said mandrel taking up the first axial position in the deactivated mode of the tool and being displaceable to the second axial position in order to activate the tool to its activated mode;

a spline bar mountable in a recess in the tool body and defining an outwardly extending guide path, wherein the spline bar defines a linear guide path extending parallel to the axis of movement of the mandrel, in which the linear guide path is defined by the axis of the spline bar, and the outwardly extending guide path is defined by a sloping guide ramp provided on the spline bar; and at least one first travel block coupled with the mandrel for movement therewith;

in which the working component is mountable on the spline bar for movement along said outwardly extending guide path, the at least one said first travel block being engageable with the working component as the mandrel moves from its first position to its second position in order to move the working component along the outwardly extending path from its withdrawn position to its outwardly deployed position.

2. A tool according to claim 1, including at least one second travel block coupled with the mandrel for movement therewith and slidably mounted on said spline bar for movement along the linear guide path, at least one said second travel block being engageable with the working component as the mandrel moves from its second position to its first position in order to move the working component along the outwardly extending guide path from its outwardly deployed position to its withdrawn position.

3. A tool according to claim 1, in which the spline bar is fixedly mounted in the recess, by at least one lock block.

4. A tool according to claim 1, in which the mandrel is arranged to be biased towards the first axial position, and to be movable under hydraulic pressure action against the biasing to take up its second axial position.

5. A tool according to claim 1, in which the mandrel is arranged to be displaced from the first to the second position upon launch of an activator down the drillstring.

6. A tool according to claim 1, in which the spline bar and the working component have cooperating guide elements which define said outwardly extending guide path.

7. A tool according to claim 6, in which the guide elements comprise at least one sloping ramp on the spline bar and a corresponding guide way on the working component.

8. A tool according to claim 1, further comprising at least one shoulder formed in at least one said first travel block and at least one step formed on said working component, wherein engagement between at least one step and at least one said shoulder prevents the working component from becoming detached from the tool.

9. A tool according to claim 1, further comprising at least one pocket formed in said working component, wherein engagement between at least one flat formed on a top of said sloping ramp with at least one said pocket locks said working component in the outwardly deployed operative position.

10. A tool according to claim 1, in which the working component is a cutter block of an under-reamer or a stabiliser.

* * * * *